US007786366B2

(12) United States Patent
Moffatt

(10) Patent No.: US 7,786,366 B2
(45) Date of Patent: Aug. 31, 2010

(54) METHOD AND APPARATUS FOR UNIVERSAL ADAPTIVE MUSIC SYSTEM

(76) Inventor: Daniel William Moffatt, 6433 Parnell Ave., Edina, MN (US) 55435

( * ) Notice: Subject to any disclaimer, the term of this patent is extended or adjusted under 35 U.S.C. 154(b) by 943 days.

(21) Appl. No.: 11/174,900

(22) Filed: Jul. 5, 2005

(65) Prior Publication Data

US 2006/0005692 A1 Jan. 12, 2006

Related U.S. Application Data

(60) Provisional application No. 60/585,617, filed on Jul. 6, 2004.

(51) Int. Cl.
*G10H 1/00* (2006.01)

(52) U.S. Cl. ..... 84/600; 84/615; 84/622; 84/634; 84/653; 84/659; 84/666

(58) Field of Classification Search ..... None
See application file for complete search history.

(56) References Cited

U.S. PATENT DOCUMENTS

| | | | |
|---|---|---|---|
| 3,073,922 | A | 1/1963 | Miller |
| 4,527,456 | A | 7/1985 | Perkins et al. |
| 4,783,812 | A | 11/1988 | Kaneoka |
| 4,787,051 | A | 11/1988 | Olson |
| 4,852,443 | A | 8/1989 | Duncan et al. |
| 4,998,457 | A | 3/1991 | Suzuki et al. |
| 5,027,115 | A | 6/1991 | Sato et al. |
| 5,181,181 | A | 1/1993 | Glynn |
| 5,315,057 | A | 5/1994 | Land et al. |
| 5,442,168 | A | 8/1995 | Gurner et al. |
| 5,502,276 | A | 3/1996 | Jameson |
| 5,513,129 | A | 4/1996 | Bolas et al. |
| 5,533,903 | A | 7/1996 | Kennedy |
| 5,589,947 | A | 12/1996 | Sato et al. |
| 5,670,729 | A | 9/1997 | Miller et al. |
| 5,691,898 | A | 11/1997 | Rosenberg et al. |
| 5,734,119 | A | 3/1998 | France et al. |
| 5,875,257 | A | 2/1999 | Marrin et al. |
| 5,973,254 | A | 10/1999 | Yamamoto |
| 5,977,471 | A | 11/1999 | Rosenzweig |
| 6,075,195 | A | 6/2000 | Gabai et al. |
| 6,096,961 | A | 8/2000 | Bruti et al. |
| 6,150,599 | A | 11/2000 | Fay et al. |
| 6,175,070 | B1 | 1/2001 | Naples et al. |
| 6,222,522 | B1 | 4/2001 | Mathews et al. |
| 6,232,541 | B1 | 5/2001 | Kumagai |
| 6,313,386 | B1 | 11/2001 | Capobianco et al. |
| 6,429,366 | B1 | 8/2002 | Terada |
| 6,462,264 | B1 | 10/2002 | Elam |
| 6,743,164 | B2 | 6/2004 | Airaudi et al. |

(Continued)

FOREIGN PATENT DOCUMENTS

| | | |
|---|---|---|
| FR | 1 258 942 | 4/1961 |

(Continued)

*Primary Examiner*—Marlon T Fletcher
(74) *Attorney, Agent, or Firm*—Dorsey & Whitney LLP; Nathan J. Witzany, Esq.

(57) ABSTRACT

The present invention is method and apparatus for assistive music performance. More specifically, the present invention is an interactive wireless music apparatus comprising actuating an event originating on a remote wireless device. The transmitted event received by a processing host computer implements the proper handling of the event.

47 Claims, 6 Drawing Sheets

U.S. PATENT DOCUMENTS

| | | | | |
|---|---|---|---|---|
| 6,867,965 | B2 * | 3/2005 | Khoo | 361/679.3 |
| 6,881,888 | B2 | 4/2005 | Akazawa et al. | |
| 7,045,698 | B2 | 5/2006 | Miyamoto | |
| 7,099,827 | B1 | 8/2006 | Tamura | |
| 7,126,051 | B2 | 10/2006 | Fay et al. | |
| 7,129,405 | B2 | 10/2006 | Moffatt et al. | |
| 7,319,185 | B1 | 1/2008 | Wieder | |
| 2001/0015123 | A1 | 8/2001 | Nishitani et al. | |
| 2001/0045154 | A1 | 11/2001 | Aoki | |
| 2002/0002898 | A1 | 1/2002 | Schmitz et al. | |
| 2002/0007720 | A1 | 1/2002 | Aoki et al. | |
| 2002/0044199 | A1 * | 4/2002 | Barzebar et al. | 348/14.01 |
| 2002/0056622 | A1 | 5/2002 | Yamashita et al. | |
| 2002/0112250 | A1 * | 8/2002 | Koplar et al. | 725/153 |
| 2002/0121181 | A1 | 9/2002 | Fay et al. | |
| 2002/0198010 | A1 | 12/2002 | Komsi et al. | |
| 2003/0037664 | A1 | 2/2003 | Comair et al. | |
| 2004/0069119 | A1 | 4/2004 | Juszkiewicz | |
| 2004/0089142 | A1 | 5/2004 | Georges et al. | |
| 2004/0137984 | A1 | 7/2004 | Salter | |
| 2004/0139842 | A1 | 7/2004 | Brenner et al. | |
| 2004/0154461 | A1 | 8/2004 | Havukainen et al. | |
| 2004/0266491 | A1 | 12/2004 | Howard et al. | |
| 2005/0071375 | A1 * | 3/2005 | Houghton et al. | 707/104.1 |
| 2005/0172789 | A1 | 8/2005 | Hsu et al. | |
| 2005/0202385 | A1 * | 9/2005 | Coward et al. | 434/307 R |
| 2006/0005692 | A1 | 1/2006 | Moffatt | |
| 2006/0011042 | A1 | 1/2006 | Brenner et al. | |
| 2006/0034301 | A1 | 2/2006 | Anderson et al. | |
| 2006/0036941 | A1 * | 2/2006 | Neil | 715/526 |
| 2006/0054006 | A1 | 3/2006 | Akazawa | |
| 2006/0239246 | A1 * | 10/2006 | Cohen et al. | 370/352 |
| 2006/0288842 | A1 | 12/2006 | Sitrick et al. | |
| 2007/0087686 | A1 | 4/2007 | Holm et al. | |
| 2007/0124452 | A1 | 5/2007 | Mohammed | |
| 2007/0131098 | A1 | 6/2007 | Moffatt | |
| 2007/0157259 | A1 * | 7/2007 | Koplar et al. | 725/81 |
| 2007/0261535 | A1 | 11/2007 | Sherwani et al. | |
| 2008/0032723 | A1 * | 2/2008 | Rosenberg | 455/466 |
| 2008/0126294 | A1 * | 5/2008 | Ray et al. | 707/1 |
| 2009/0138600 | A1 * | 5/2009 | Baum et al. | 709/226 |

FOREIGN PATENT DOCUMENTS

| | | |
|---|---|---|
| JP | 2000-195206 | 7/2000 |
| JP | 2001-185012 | 7/2001 |
| WO | WO 95/21436 | 8/1995 |

* cited by examiner

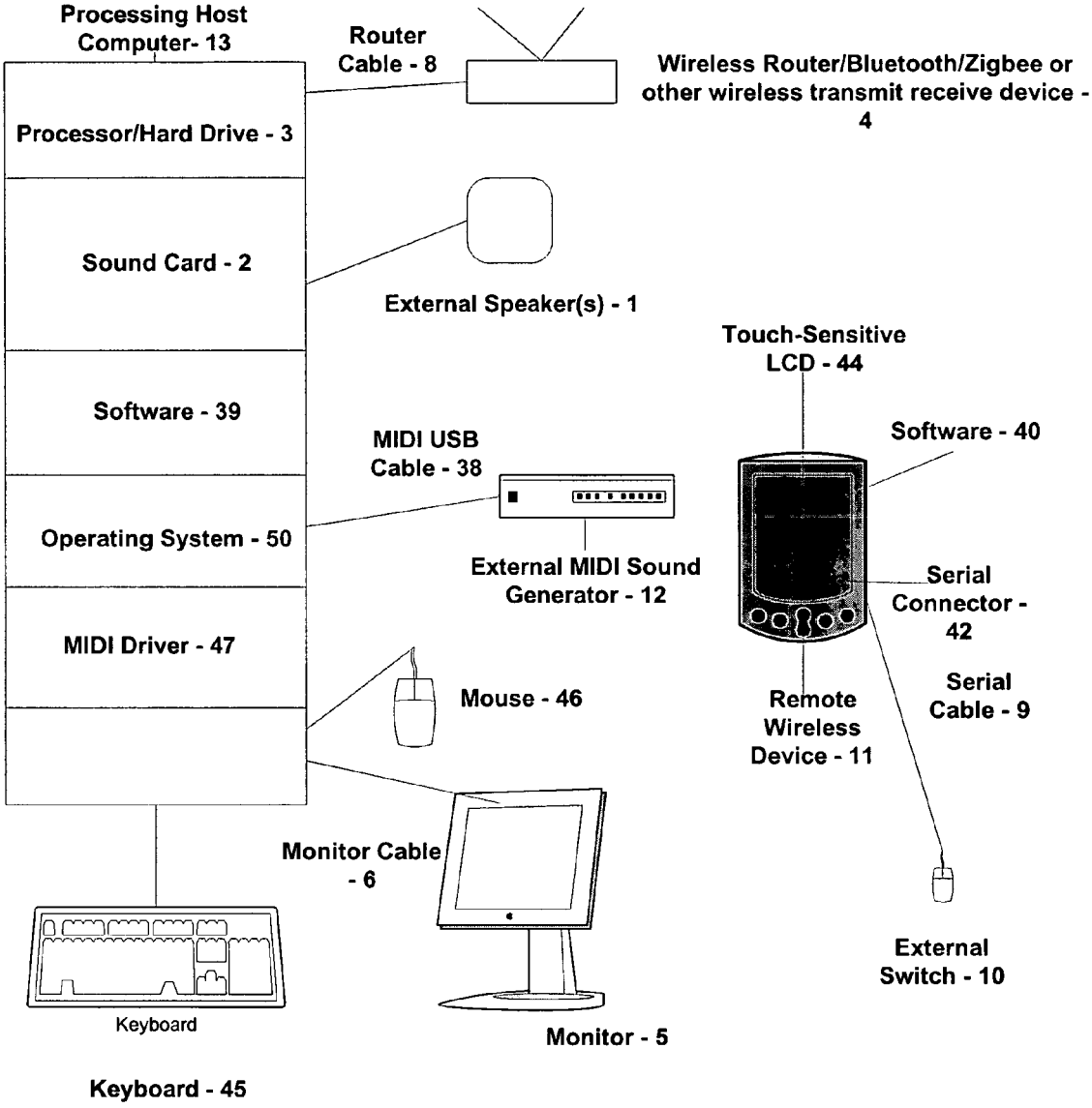
Fig. 1 - Schematic

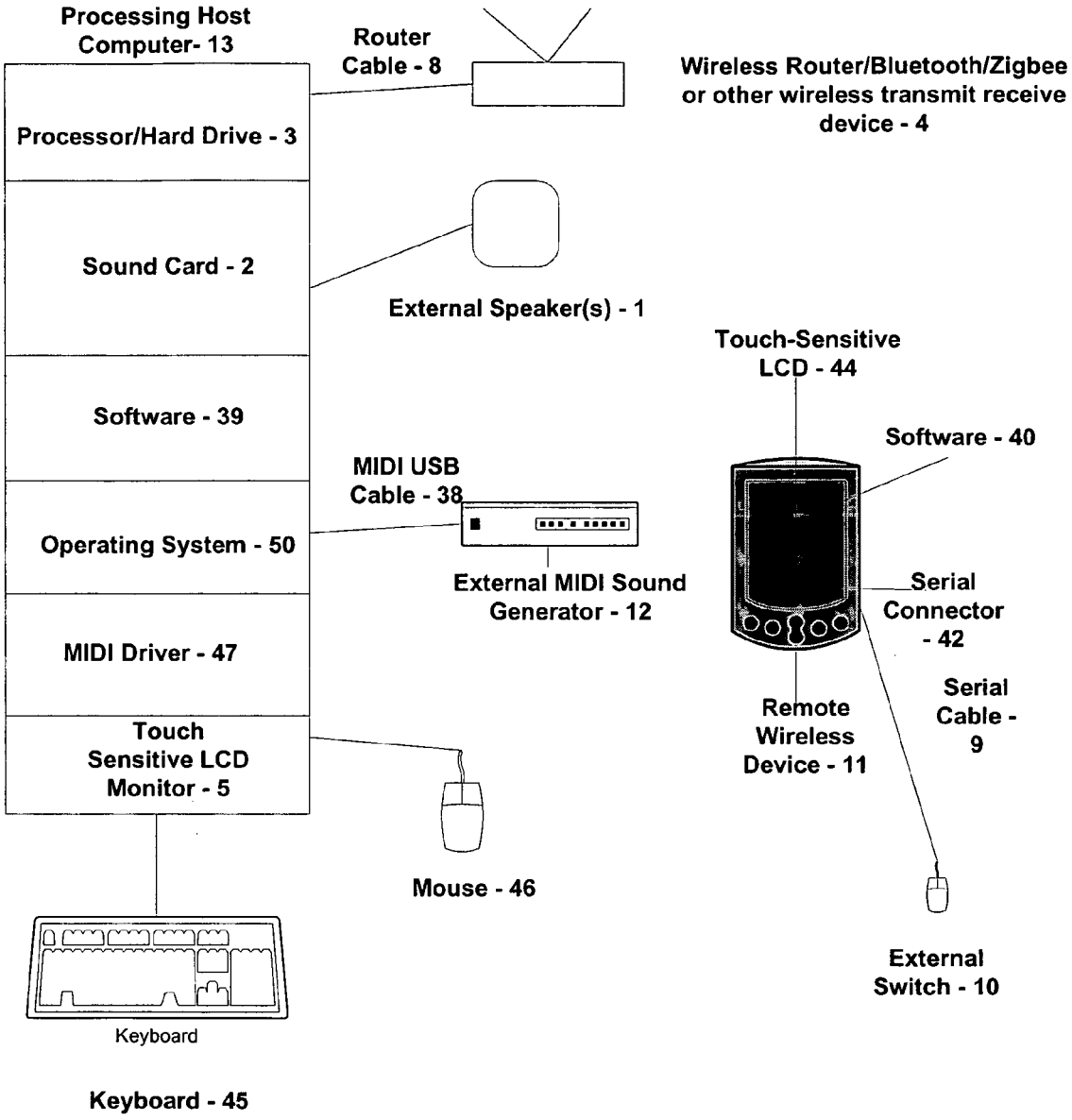
Fig. 2 - Alternative Schematic

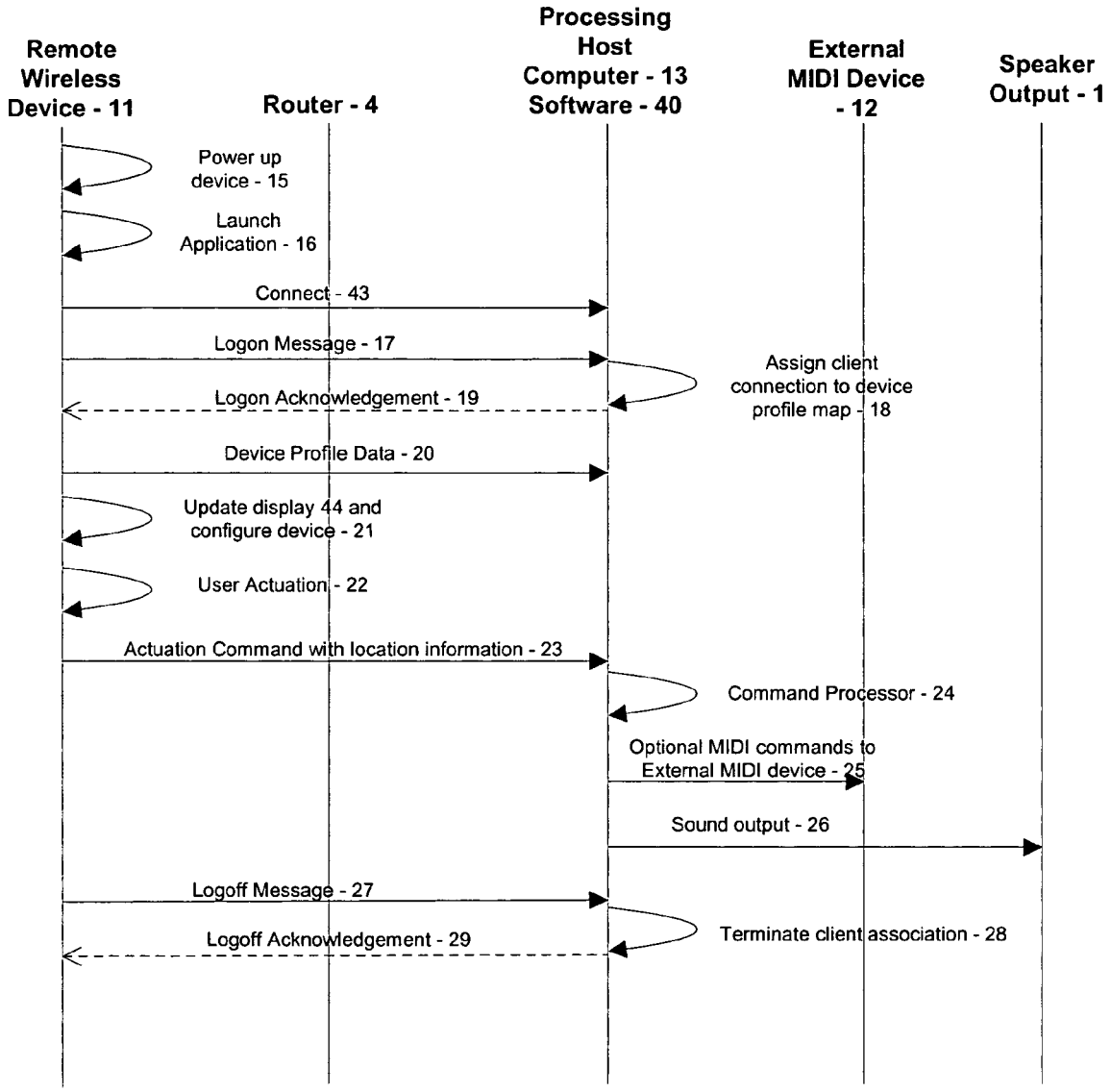
Fig. 3: Standard Operation Processing

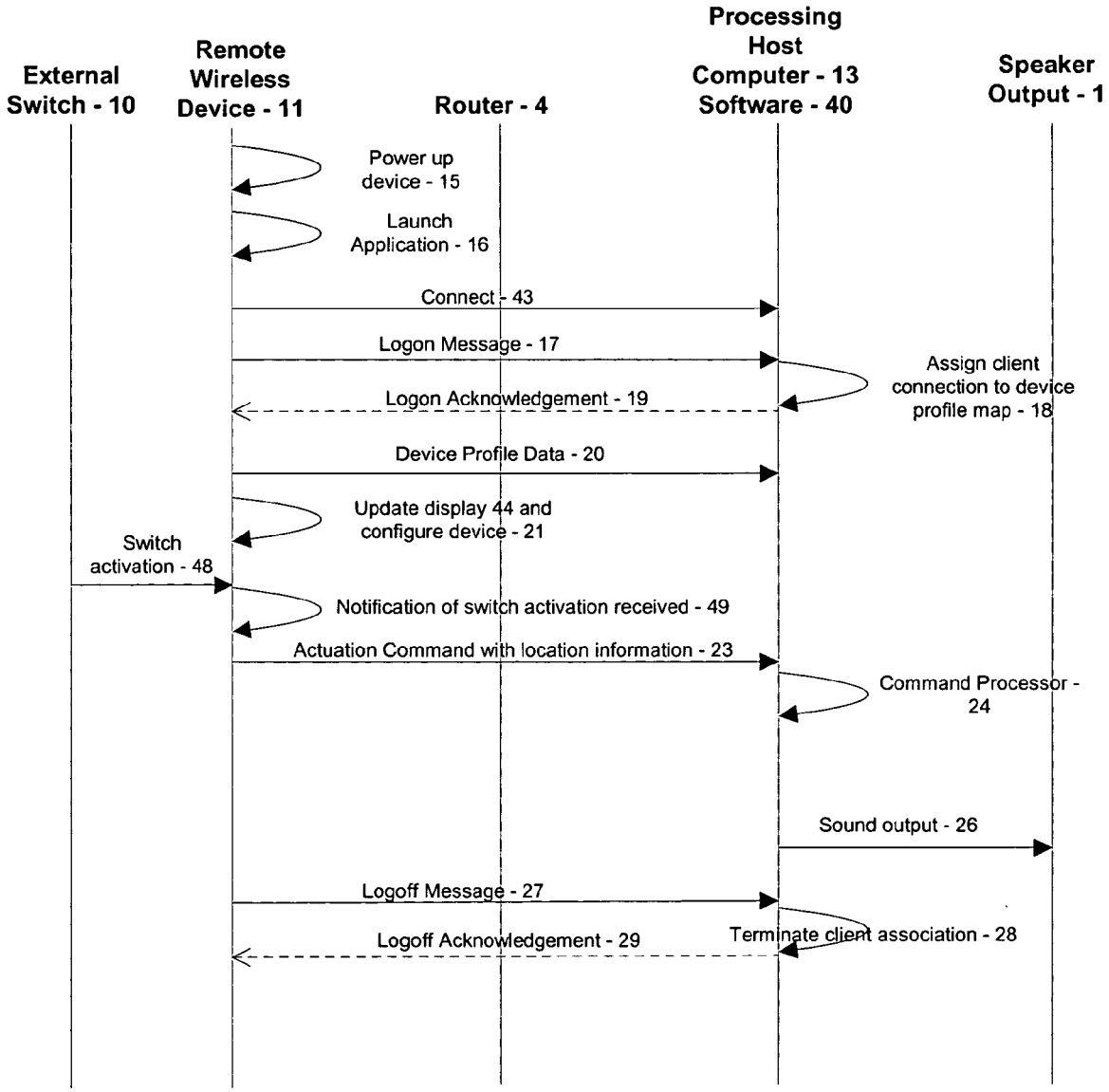
Fig. 3A: Standard Operation Processing with External Switch

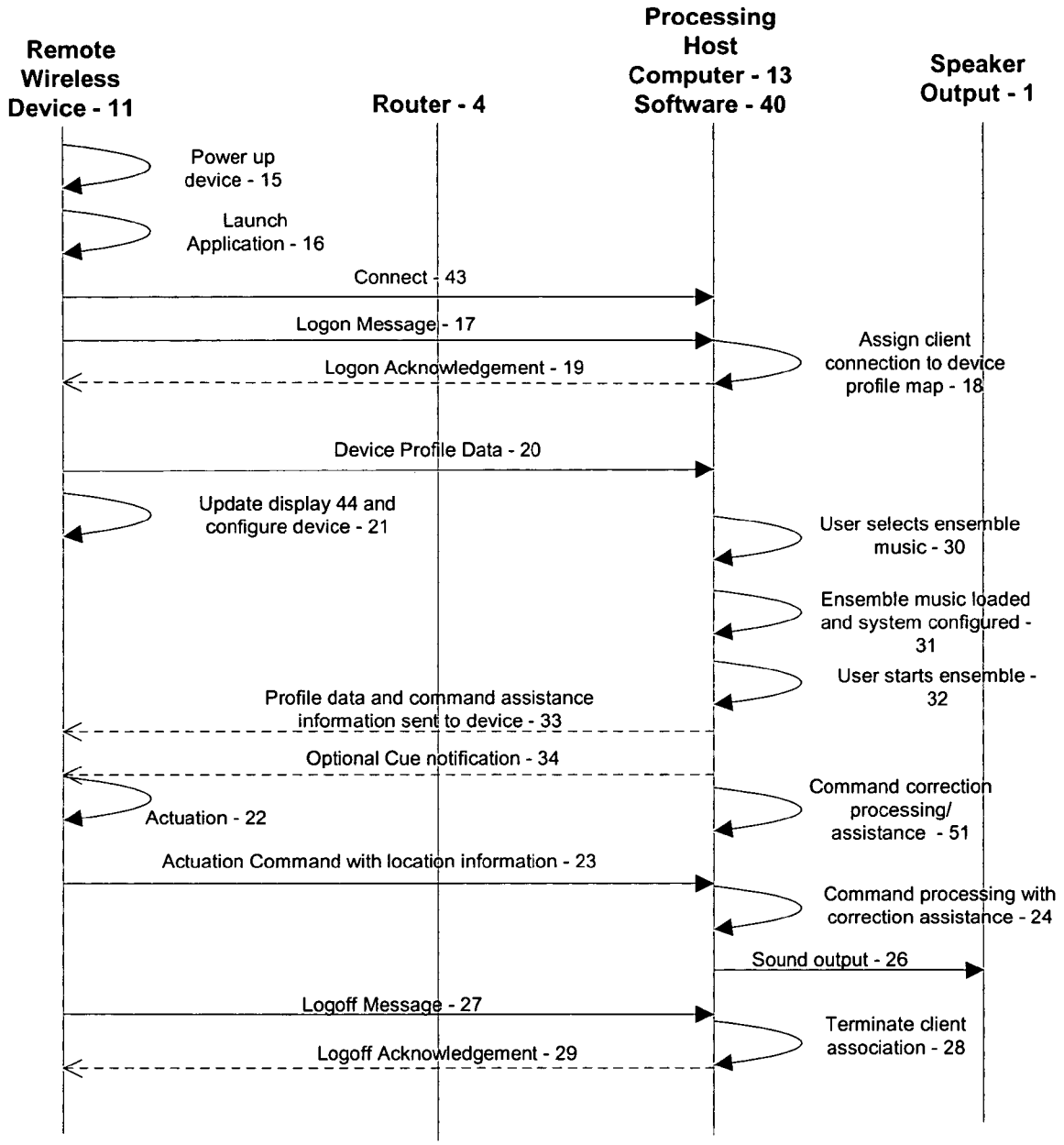
Fig. 4: Ensemble Operation Processing

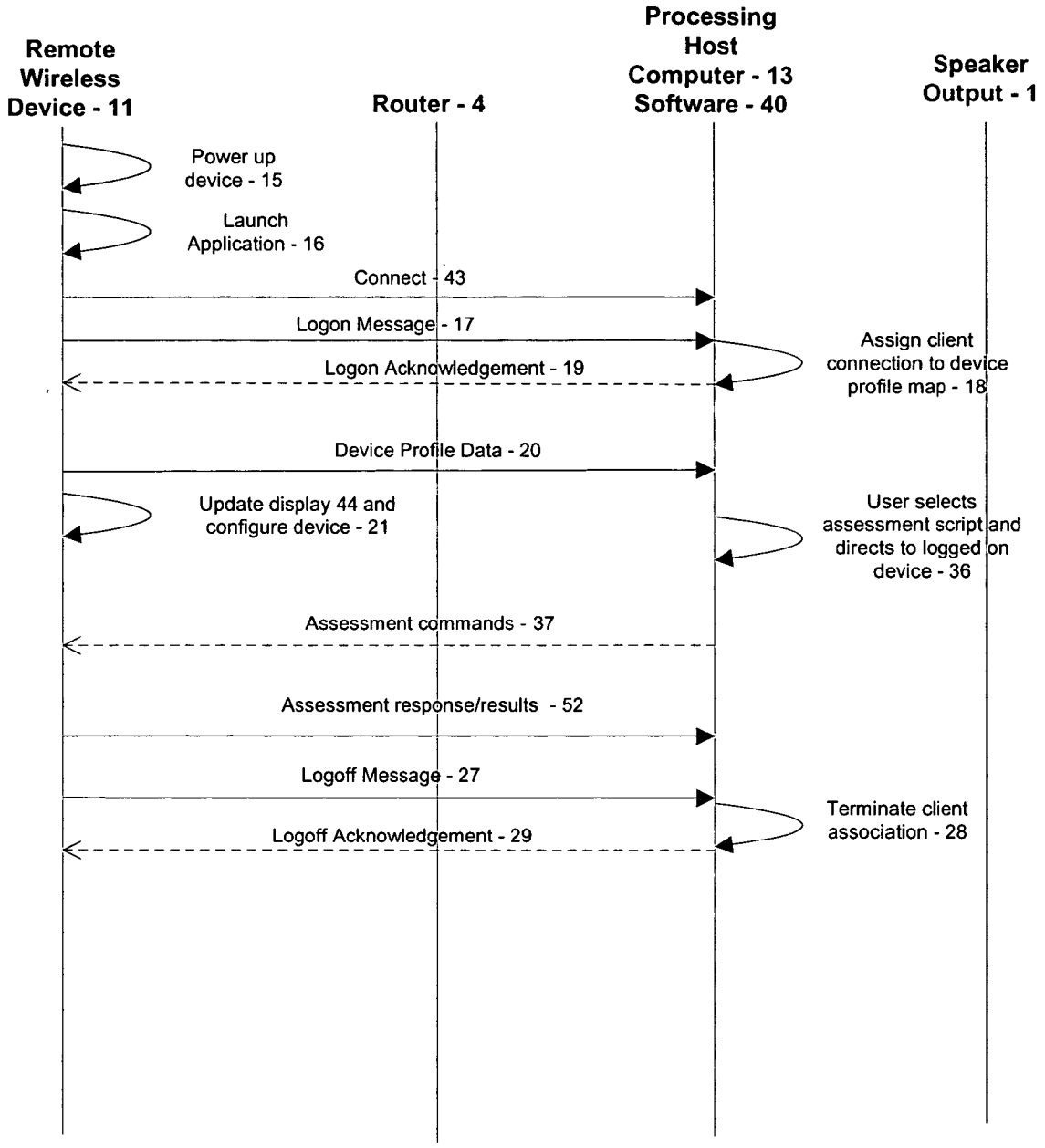
Fig. 5: Assessment Operation Processing

METHOD AND APPARATUS FOR UNIVERSAL ADAPTIVE MUSIC SYSTEM

CROSS-REFERENCE TO RELATED APPLICATION(S)

This application claims priority to U.S. Provisional Patent Application No. 60/585,617 filed Jul. 6, 2004, which is incorporated herein by reference in its entirety.

TECHNICAL FIELD

The present invention relates generally to the field of music. More specifically, the present invention relates to a wireless electronic musical instrument; enabling musicians of all abilities to learn, perform, and create sound.

BACKGROUND OF THE INVENTION

For many years as is common today, performing music is restricted to traditional instruments such as acoustic and electronic keyboards, stringed, woodwind, percussive and brass. In all of the instruments in each of these classifications, a high level of mental aptitude and motor skill is required to adequately operate the instrument. Coordination is necessary to control breathing, fingering combinations and expression. Moreover, the cognitive ability to read the music, watch the conductor for cues and listen to the other musicians to make adjustments necessary for ensemble play require high cognitive function. Most school band programs are limited to the use of these instruments and limit band participation to only those students with the physical and mental capacity to operate traditional instruments.

For example, a students with normal mental and physical aptitude shows an interest in a particular traditional instrument and the school and/or parents make an instrument available with options for instruction. The child practices and attends regular band rehearsals. Over time the student becomes proficient at the instrument and playing with other musicians. This is a very common scenario for the average music student.

However, this program assumes all children have adequate cognitive and motor function to proficiently operate a traditional instrument. It assumes that all children are capable of reading music, performing complex fingering, controlling dynamics and making necessary adjustments for ensemble performance. The currently available musical instruments do not consider individuals with below normal physical and mental abilities. Hence, it prohibits the participation of these individuals.

Consequently, there is a need in the art for a universal adaptive musical instrument that enables people of all abilities to perform music alone, with other individuals of similar abilities or with others in a traditional band setting. This solution should provide the necessary flexibility to assist individuals with their particular disability. In essence, implement corrective technology to close the gap and enable them to fully participate in music.

BRIEF SUMMARY OF THE INVENTION

The present invention, in one embodiment, is a universal adaptive musical system. The system includes a host computing device, one or many remote wireless computing devices (actuator), a speaker configuration/output component and a wireless router. The actuator is configured to transmit a signal upon actuation and the voltage converter is configured to convert the signal from the actuator into a data stream. The processing computer is configured to convert the data stream into a first output signal and a second output signal. The speaker is configured to receive the first output signal and emit sound. The output component is configured to receive the second output signal and perform an action based on the second output signal.

According to a further embodiment, the present invention is a method of music performance. The method includes the wireless transmission of a events on a remote wireless device. The data transferred over a wireless network is processed by the processing host computer which creates the output.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the drawings and detailed description are to be regarded as illustrative in nature and not restrictive.

BRIEF DESCRIPTION OF THE DRAWINGS

FIG. 1 is a schematic diagram of one embodiment of the present invention.

FIG. 2 is a schematic diagram of an alternative embodiment of the present invention.

FIG. 3 is a sequence diagram showing standard operation of the apparatus, according to one embodiment of the present invention.

FIG. 4 is a sequence diagram showing operation during ensemble mode of the apparatus, according to one embodiment of the present invention.

FIG. 5 is a sequence diagram depicting the operational flow during assessment mode using the apparatus, according to one embodiment of the present invention.

DETAILED DESCRIPTION

FIG. 1 shows a schematic diagram a music apparatus 13, according to one embodiment of the present invention. As shown in FIG. 1, the music apparatus 13 may include optional external speakers 1, an external wireless transmitter 4, and external MIDI (Musical Instrument Digital Interface) sound generator 13, a processing computer 13 having a processor 3, software 39, and an internal/external sound card 2 and a display monitor 5. The processing computer 13 is connected to the display monitor 5 by a monitor cable 6. The processing computer 13 is connected to the speaker 1 by a speaker line out cable 7. The wireless transmitter 4 is connected to the processing computer 13 via a cable 8. Likewise, the optional external MIDI device 12 is connected to the processing computer 13 via a MIDI cable 38. The remote wireless device 11 contains a processor 41, touch-sensitive LDC display 44 and software 40. In an alternative embodiment of this remote wireless device 11, serial connector 41 attached to serial cable 9 and actuator switch 10 is optional.

FIG. 2 presents an alternative aspect of the present invention. The processing computer 13 contains a touch-sensitive liquid crystal display (LCD) 5, thus eliminating the monitor display cable 6.

In one embodiment, the actuator 10 may be any known mechanical contact switch that is easy for a user to operate. Alternatively, different types of actuators, for example, light sensors, may also be used. In one aspect of the present invention, the number of actuators 10 can vary according to factors such as the user's skill, physical capabilities and actuator implementation.

According to one embodiment, the processing computer 13/14 may be any standard computer, including a personal computer running a standard Windows® based operating system, with standard attachments and components (e.g., a CPU, hard drive, disk and CD-ROM drives, a keyboard and a mouse). The processor 3 may be any standard processor such as a Pentium® processor or equivalent.

FIG. 3 depicts a sequence diagram of standard operational flow. The remote wireless device 11 is switched on. The remote wireless device software 40 is started and establishes a wireless connection 43 with the host processing PC 13/14 via the wireless transmitter (router) 4. Upon successful connection, the remote wireless device transmits a user log on or handshake message 17 to the host PC 13/14. The host PC 13/14 returns an acknowledgement message 19. Upon successful log on, the remote wireless device 11 notifies the host PC 13/14 of it's current device profile 20. The device profile 20 contains data necessary for the host PC 13/14 to properly service future commands 23 received from the remote device 11. Specifically, during host PC synchronization a map of host PC 13/14 actions that correspond to specific remote device 11 x-y coordinates locations (or regions of x-y coordinates) on the remote device 11 LCD display 44 are created. With the mapping complete, both the host PC 13/14 and remote wireless device 11 are now synchronized. After successful synchronization, the host PC 13/14 and the remote wireless device 11 refresh their displays 5, 44 respectively. The user may press the LCD display 44 to send a command 23 to the host PC 13/14. A remote device command 23 transmitted to the host PC 13/14 contains an identifier to the location the user pressed on the remote device LCD 44. A remote device command 23 may optionally include meta data such as position change or pressure intensity. When the command 23 is received by the host PC 13/14, the host PC 13/14 invokes the command processor 24 which executes the action mapped to the location identifier. This action, handled in the command processor 24 may include directing a MIDI command or series of commands to the host PC 13/14 MIDI output, sending a MIDI command or series of commands to an external MIDI sound generator 12, playing a media file or instructing the host PC 13/14 to change a configuration setting. It may also include a script that combines several disparate functions. The command processor 24 continues to service command messages until the remote device 11 logs off 27. Upon transmission and receipt by the host PC 13/14 of a log off message 27 of a remote device 11, the host PC 13/14 discontinues processing commands and destroys the action map.

FIG. 3A is a sequence diagram showing an alternative flow when an external switch, or actuator 10 is the source of the activation. The external switch actuator is connected to the remote wireless device 11 via serial communication cable 9. The user initiates operation by pressing the actuator button 10. Upon engagement by the user 48, the actuator 10 changes a pin condition on the serial connection 9. This event is recognized by the remote wireless device software 40. The remote device software 40 references a map that indicates the location identifier 49 to be transmitted to the host PC 13/14. The remote device 11 transmit the location identifier to the host PC 13/14.

According to one embodiment of this invention, the host PC 13/14 supports a multiple number of remote wireless devices 11 restricted only by the underlying limitations of the hardware and operating system (wireless transmitter 4, processor 3).

According to one embodiment, the command processing of MIDI data involves the use of a known communication music computing standard called a Musical Instrument Digital Interface ("MIDI"). According to one embodiment, the operating system 50 provides a library of preset MIDI sounds. As is understood in the art, each MIDI command is sent to the MIDI driver (not shown part of the operating system 50) of the host PC 13/14. The MIDI driver directs the sound to the sound card 2 for output to the speaker 1.

Alternatively, the MIDI command is redirected by the MIDI driver to an external MIDI sound module 12. The MIDI sound module may be any commercially-available MIDI sound module containing a library of audio tones. The MIDI sound module 12 generates a MIDI sound output signal which may be directed to the speakers 1.

FIG. 4 is a sequence operational diagram depicting system operation in ensemble mode. In ensemble mode, the host PC 13/14 manages a real-time performance of one or many users. The music performed is defined in an external data file using the standard MIDI file format. The remote device 11 start up and log on sequence is identical to the sequence illustrated in FIG. 3. The change to ensemble mode takes place on the host PC 13/14. A system administrator selects a MIDI file to perform 30. The host PC 13/14 opens the MIDI file and reads in the data 31. The MIDI file contains all of the information necessary to playback a piece of music. This operation 31 determines the number of needed performers and assigns music to each performer. Performers may be live (a logged on performer) or a substitute performer (computer). The music assigned to live performers considers the performers ability and assistance needs (assessment profile). The system administrator selects the tempo for the performance and starts the ensemble processing 35. The host PC 13/14 and the remote wireless device 11 communicate during ensemble processing and offer functionality to enhance the performance of individuals that require assistance with the assigned part. These enhancements include visual cueing 34, command filtering, command location correction, command assistance and command quantization 51. Visual cueing creates a visual cue on the remote device 11 LCD 44 alerting the performer as to when and where to press the remote device LCD 44. In one embodiment, the visual cue may be a reversal of the foreground and background colors of a particular region of the remote device LCD 44. The visual cueing assists performers that have difficultly reading or hearing music. Using the MIDI file as a reference for the real-time performance, the command sequence expectation is known by the host PC 13/14 managing the performance. This enables the ensemble manager to provide features to enhance the performance. The command filter ignores out of sequence commands or commands that are not relevant at the time received within the performance. Command location correction adjusts the location identifier when the performer errantly presses the remote device LCD 44 at the incorrect x-y coordinate or region. Command assistance automatically creates commands for performers that do not respond within a timeout window. Command quantization corrects the timing of the received command in context to the performance.

FIG. 5 is a sequence operational diagram depicting system operation in assessment mode. In assessment mode, the host PC 13/14 manages series of assessment scripts to determine the performers cognitive and physical abilities. This evaluation enhances ensemble assignment and processing to optimize real-time ensemble performance. The remote device 11 start up and log on sequence is identical to the sequence illustrated in FIG. 3. The change to assessment mode takes place on the host PC 13/14. A system administrator selects an assessment script 36 and directs the assessment test to a particular remote device 11. The user responds 52 to his/her ability. The script may contain routines to record response time, location accuracy (motor skill) and memory recall (cognitive) using sequence patterns.

In one embodiment of the invention, several default device templates are defined. These templates define quadrilateral regions within the remote device 11 LCD display 44. Each defined region has an identifier used in remote device 11 commands to the host PC 13/14. The command processor on the host PC 13/14 determines the location on the remote device 11 LCD 44 using this template region identifier.

In one embodiment of the invention, a region may be designated as a free form location. A remote device 11 region with this free form attribute includes additional information with the commands transmitted to the host PC 13/14. This meta data includes relative movement on the remote device 11 LCD 44. The change in x and y coordinate values is included with the location identifier. Coordinate delta changes enable the command processor to extend the output of the command to include changes in dynamics, traverse a scale or series of notes, modify sustained notes or process and series of MIDI commands.

In one embodiment of the invention, ensemble configurations may be defined on the host PC 13/14. Ensemble configurations are pre-defined remote device configuration sets which detail regions definitions for known remote devices 11. These ensemble configuration sets may be downloaded to the remote devices 11 via the host PC 13/14 simultaneously.

In one embodiment of the invention, the mechanism of data transmission between the remote wireless device 11 and the host PC 13/14 may be TCP/IP, Bluetooth, 802.15 or other wireless technology.

I claim:

1. An interactive adaptive music apparatus comprising:

at least one remote wireless device having a processor, a touch-sensitive screen, and software configured to transmit data upon action on the touch-sensitive screen as well as receive template configurations from a processing host device;

a processing host computer having one or more libraries of preset media files, downloadable template configurations, and processing software configured to receive the transmitted data from the at least one remote wireless device;

a transmit/receive device to enable wireless transmission between the remote wireless device and the processing host computer;

a configurable map associating each of one or more designated x and y coordinate locations of a downloadable template configuration for the tough-sensitive screen of the at least one remote device with one or more actions of the processing host computer, wherein the processing host computer is configured to process the received data according to the map and execute or more associated actions, the one or more associated actions including directing a mapped command to an output device; and an output device configured to receive the command and having at least one of a speaker for emitting sound based on the command or a display monitor for rendering an image based on the command.

2. The apparatus of claim 1 wherein the sound and the action on the touch-sensitive screen are interactive.

3. The apparatus of claim 1 wherein the output comprises a data transmission from a remote wireless device, and the action comprises the processing host computing device creating at least one of sound or visual output.

4. The apparatus of claim 3 wherein the action further comprises playing a MIDI file.

5. The apparatus of claim 3 wherein the action further comprises playing a media file such as audio or video.

6. The apparatus of claim 3 wherein the action further comprises playing CD or DVD media.

7. The apparatus of claim 3 wherein the action further comprises sending a MIDI command or series of MIDI commands to the MIDI output.

8. The apparatus of claim 3 wherein the output further comprises remote wireless device transmission of x-y coordinates of the touch-sensitive screen location identification.

9. The apparatus of claim 3 wherein the output further comprises remote wireless device transmission of x-y coordinate delta values for extended processing.

10. The apparatus of claim 1 wherein processing host computer display output component comprises a processing host computer display monitor and the action further comprises displaying a music notes, clefs and staves on the display monitor.

11. The apparatus of claim 10 wherein the processing host computer display output further comprises remote wireless device emulation representing a mirror image of the remote device touch-sensitive screen display.

12. The apparatus of claim 10 wherein the processing host computer display output further comprises remote wireless device configuration editing for downloading to one or more remote wireless devices.

13. The apparatus of claim 10 wherein the processing host computer display output further comprises ensemble configuration creation and editing for download to one or more remote wireless devices.

14. The apparatus of claim 10 wherein the processing host computer display output further comprises display of remote wireless devices logged on.

15. The apparatus of claim 10 wherein the processing host computer display output further comprises display of one or more files in the media libraries.

16. The apparatus of claim 10 wherein the processing host computer display output further comprises the display of performer assessment profiles.

17. The apparatus of claim 10 wherein the processing host computer display output further comprises the display of MIDI ensemble performance files.

18. The apparatus of claim 1 wherein the remote wireless device touch-sensitive screen output displays active mapped locations or regions.

19. The apparatus of claim 1 wherein the remote wireless device touch-sensitive screen output displays music notes, clefs and staves or other symbols.

20. The apparatus of claim 1 wherein the remote wireless device touch-sensitive screen output supports visual cues for ensemble and playback performance.

21. The apparatus of claim 1 wherein the remote wireless device touch-sensitive screen output displays words, text or icons to represent active mapped locations and regions.

22. The apparatus of claim 1 wherein the remote wireless device touch-sensitive screen output supports various colors to represent active mapped locations and regions.

23. The apparatus of claim 1 further comprising a remote wireless device external serial actuator configured to represent an x, y mapped location.

24. The apparatus of claim 1 further comprising ensemble performance processing by the processing host computer.

25. The apparatus of claim 24 wherein the processing host computer software reads a MIDI file and dynamically determines performers, instrumentation and designates parts.

26. The apparatus of claim 24 wherein the processing host computer software supports ensemble processing by enabling visual cueing, command filtering, command location correction, command assistance and command quantization.

27. The apparatus of claim 24 wherein the processing host computer automates the performance of missing or unmatched parts.

28. The apparatus of claim 24 wherein the processing host computer sends commands to the remote wireless device to update and support ensemble performance and performer assist functions.

29. The apparatus of claim 1 further comprising a performer assessment function.

30. The apparatus of claim 29 wherein the performer assessment function determines physical and mental capabilities.

31. The apparatus of claim 1 wherein the downloadable template configurations define one or more mapped locations or regions represented on the touch-sensitive screen display as quadrilateral shapes.

32. The apparatus of claim 1 wherein the downloadable template configurations are derived and maintained by the host computer software and are designed to adapt to any display resolution and dimension.

33. The apparatus of claim 1 wherein the downloadable template configurations are customizable by enabling each region to be independently configured.

34. The apparatus of claim 1 wherein the downloadable template configurations are used to define one or more location mappings used by the processing host computer software in command processing.

35. The apparatus of claim 1 further comprising a free form region type.

36. The apparatus of claim 35 wherein the free form region transmits data representing movement along the remote wireless device touch-sensitive screen display.

37. The apparatus of claim 35 wherein the free form region type enables extended processing of events such as dynamics, pitch modification, scale traversing, random pitch generation or other based on x, y or z coordinate changes.

38. The apparatus of claim 1 further comprising of processing host computer ensemble configuration.

39. The apparatus of claim 38 wherein the processing host computer ensemble configuration enables independent configurations for each remote wireless device.

40. The apparatus of claim 38 wherein the processing host computer ensemble configuration enables simultaneous download of configurations to the remote wireless devices.

41. The apparatus of claim 1 further comprising of an external MIDI sound device.

42. The apparatus of claim 41 further comprising a sound card coupled to the processing host computer, and wherein the MIDI device configured to receive the output signal.

43. The apparatus of claim 42 further comprising a MIDI sound module operably coupled to the MIDI sound card, the MIDI sound module configured to receive an output signal from the sound card, process the output signal, and transmit the output signal to the processing computer.

44. The apparatus of claim 26 wherein the ensemble processing modifies an assigned part based on the proficiency and ability of the performer.

45. The apparatus of claim 1 wherein the processing host computer includes different downloadable template configurations for a plurality of multiple remote devices, and the processing host computer is configured to send a different template configuration to each of a plurality of remote devices.

46. An interactive adaptive music apparatus comprising:

at least one remote wireless device configured to transmit data upon actuation as well as receive template configuration downloads from a processing host device;

a wireless transmitter/receiver coupled to the processing host computer the processing host computer configure to receive data from the at least one remote wireless device via the wireless transmitter/receiver, including mapped commands representing actions at the at least one remote wireless device corresponding to specific coordinate locations on the at least one remote wireless device, process the mapped commands to create an output signal, and distribute template configurations to the at least one remote wireless device;

a speaker configured to receive the output signal and emit sound; and a processing host computer display monitor configured to display an image based on mode, current operation and interactive events.

47. An interactive adaptive music apparatus for music performance comprising:

a MIDI database comprising MIDI files for a musical performance;

a processing host computer configured to determine parts and players of the musical performance and having access to the MIDI database;

speakers for emitting sound based on the MIDI files; and a remote wireless device that upon actuation transmits a performance event to the processing host computer; wherein at least one of the processing host computer and the remote wireless device provide visual cueing, command filtering, command location correction, command assistance, and command quantization for the performance event data to create modified performance event data; and wherein the host computer creates output based on the modified performance event data and the MIDI files, and the speakers emit sound based on the processing host computer output.

* * * * *

UNITED STATES PATENT AND TRADEMARK OFFICE

CERTIFICATE OF CORRECTION

PATENT NO. : 7,786,366 B2
APPLICATION NO. : 11/174900
DATED : August 31, 2010
INVENTOR(S) : Daniel William Moffatt It is certified that error appears in the above-identified patent and that said Letters Patent is hereby corrected as shown below:

CLAIMS

| Column | Line | PTO | Should Read |
|---|---|---|---|
| 5 | 51 | "tough-sensitive screen" | -- touch-sensitive screen -- |
| 5 | 55 | "and execute or more" | -- and execute the one or more -- |
| 6 | 27 | "editing for downloading" | -- editing for download -- |
| 7 | 55 | "device configured to" | -- device is configured to -- |
| 8 | 19 | "coupled to the processing" | --coupled to a processing -- |
| 8 | 20 | "hose computer configure to" | -- host computer configured to -- |

Signed and Sealed this

Sixteenth Day of November, 2010

David J. Kappos

David J. Kappos
*Director of the United States Patent and Trademark Office*